US006306003B1

(12) United States Patent
Nakagawa

(10) Patent No.: US 6,306,003 B1
(45) Date of Patent: Oct. 23, 2001

(54) IMPREGNATED CATHODE AND METHOD FOR MANUFACTURING THE SAME

(75) Inventor: Satoru Nakagawa, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/501,040

(22) Filed: Feb. 9, 2000

Related U.S. Application Data

(62) Division of application No. 09/110,792, filed on Jul. 6, 1998.

(30) Foreign Application Priority Data

Jul. 9, 1997 (JP) ..... 9-184023

(51) Int. Cl.[7] ..... H01J 9/04
(52) U.S. Cl. ..... 445/51
(58) Field of Search ..... 445/50–51; 313/346 DC

(56) References Cited

U.S. PATENT DOCUMENTS

| | | | | |
|---|---|---|---|---|
| 2,878,409 | * | 3/1959 | Levi | 445/51 |
| 3,623,198 | * | 11/1971 | Held | 445/51 |
| 3,879,830 | | 4/1975 | Buescher . | |
| 4,478,590 | | 10/1984 | Rychlewski . | |
| 4,957,463 | * | 9/1990 | Barnovich et al. | 445/51 |
| 4,980,603 | | 12/1990 | Kimura et al. . | |
| 5,122,707 | | 6/1992 | Nakanishi et al. . | |
| 5,808,404 | | 9/1998 | Koizumi et al. . | |
| 5,982,083 | | 11/1999 | Ju et al. . | |

FOREIGN PATENT DOCUMENTS

| | | |
|---|---|---|
| 1 098 621 | 2/1961 | (DE) . |
| 28 08 134 | 8/1979 | (DE) . |
| 0052047 | 5/1982 | (EP) . |
| 0 831 512 | 3/1998 | (EP) . |
| 44-10810 | 5/1969 | (JP) . |
| 50-103967 | 8/1975 | (JP) . |
| 58-34539 | 3/1983 | (JP) . |
| 58-87735 | 5/1983 | (JP) . |
| 5-74324 | 3/1993 | (JP) . |
| 6-103885 | 4/1994 | (JP) . |
| 6-111711 | 4/1994 | (JP) . |
| 7-105835 | 4/1995 | (JP) . |

* cited by examiner

*Primary Examiner*—Kenneth J. Ramsey
(74) *Attorney, Agent, or Firm*—Merchant & Gould P.C.

(57) ABSTRACT

An impregnated cathode whose initial electron emitting performance, lifetime property, and insulating property for an electron gun are excellent and that is suitable for mass production, and a method for manufacturing the same. In the impregnated cathode, the porosity of the sintered body of porous metal is continuously increased as the distance in the depth direction from an electron emitting face is increased. A pellet of sintered body of metal raw material has pores in it. The pores are filled with electron emitting material. The porosity is continuously increased as the distance in the depth direction from an electron emitting face is increased. Thus, since the discontinuity inside the pellet is not formed, a reaction generating free Ba continuously and smoothly proceeds on the entire pellet. In addition, since raw material powder having more than one kind of particle size is not necessary to be used, the manufacturing process can be simplified. Moreover, various functions such as lifetime property, etc. can be improved by making the porosity and porosity distribution in a certain range.

7 Claims, 14 Drawing Sheets

IMPREGNATED CATHODE AND METHOD FOR MANUFACTURING THE SAME

This application is a Divisional of application Ser. No. 09/110,792, filed Jul. 6, 1998, which application(s) are incorporated herein by reference.

FIELD OF THE INVENTION

The present invention relates to an impregnated cathode used for an electron tube and a method for manufacturing the same.

BACKGROUND OF THE INVENTION

An impregnated cathode has a basic structure in which pores of a sintered body of porous metal (pellet) are impregnated with an electron emitting material. A method for manufacturing an impregnated cathode comprises the steps of: press molding powder of a high melting point metal such as tungsten, etc.; then sintering the press molded product to form a reducing substrate having a proper porosity; and then impregnating the pores of the substrate with molten electron emitting material comprising BaO, CaO and $Al_2O_3$ as the main components. Thus, a cathode pellet is obtained. This cathode pellet is impregnated with emitting material in an amount corresponding to the volume of the sintered body and the porosity, i.e. the volume of pores.

The principle of operation of the cathode pellet will be explained below. When the cathode pellet is subjected to a high temperature activation, BaO is reduced by the pellet to generate free Ba. This free Ba thermally diffuses in pores and reaches the surface of the pellet. Then, the free Ba thermally diffuses on the surface of the pellet, to thus form a Ba monoatomic layer on the surface of the pellet. At this time, a monoatomic layer spreads to cover an area corresponding to the difference between an amount of Ba evaporated from the monolayer, which is dependent upon the temperature of the pellet, and an amount of Ba supplied from the inside of the pellet. This Ba monoatomic layer reduces the effective work function that is involved in an electron emission from 4 to 5 eV of the metal itself constituting the pellet to about 2 eV. Consequently, excellent thermionic emission is provided.

If little Ba is supplied from the inside of the pellet at the time of the operation, a necessary and sufficient area of Ba monoatomic layer cannot be formed, causing a deficiency of emission. Moreover, there arise some problems, for example, the activation takes a long time, etc.

On the contrary, if too much Ba is supplied, Ba evaporated from the surface of the pellet is increased, so that the BaO impregnated in the pellet is consumed in a short time and in turn the lifetime is shortened. Furthermore, the evaporated Ba is deposited on a counter electrode, causing unnecessary electron emission, etc.

The most important point of the operation of the impregnated cathode is to form a necessary and sufficient Ba monoatomic layer in an early stage and to keep it for a long time. The factors for forming a Ba monoatomic layer include: the amount of impregnated BaO; the reducing rate of the impregnated BaO being reduced by the pellet; the thermal diffusion velocity of free Ba in pores; and the surface thermal diffusion rate of Ba on an electron emitting face.

The design parameters for controlling the operations are: the amount of impregnation of electron emitting material; the porosity of the pellet and the spatial distribution of pores; and the cleanness of the electron emitting face, more specifically, an absence of extra electron emitting material attached to the electron emitting face. The most important thing for mass production is to control these parameters with high precision and with less variation.

Based on the above mentioned background of the principle, Publication of Japanese Patent Application (Tokko Sho) No. 44-10810 discloses an impregnated cathode, in which the evaporation of extra electron emitting material can be inhibited, the leak of current in an insulating portion of an electron gun can be reduced, and an excellent state of Ba monoatomic layer can be maintained for a long time and in turn its lifetime can be extended.

The above mentioned structure is a two-layer structure comprising a first layer having a low porosity on the side of the electron emitting face of the pellet, wherein the evaporation of the electron emitting material is inhibited; and a second layer having a high porosity formed below the first layer. According to such a two-layer structure, even after the Ba supply capacity of the first layer is exhausted (i.e. after the lifetime), Ba can be supplied from the second layer to the first layer. Consequently, the lifetime of the pellet is further extended as compared with the lifetime the first layer has naturally.

Furthermore, Publication of Japanese Patent Application (Tokkai Hei) No. 6-103885 suggests that the surface roughness of the substrate be not more than 5 $\mu$m, more preferably that the substrate be perfectly smooth, so as to easily remove the attached extra electron emitting material after impregnation.

Furthermore, Publication of Japanese Patent Application (Tokkai Sho) No. 58-87735 discloses a manufacturing method in which compressed electron emitting materials placed on the upper surfaces of the individual pellets are melted and impregnated in order to ensure the amount of impregnation of the electron emitting material.

Furthermore, Publication of Japanese Patent Application (Tokkai Hei) No. 6-103885 discloses a method of mass production in which the amount of the impregnated electron emitting materials is kept stable by classifying metal raw material powder of the pellet and controlling the porosity of the pellet.

Furthermore, a mechanical method using a brush, a metal-clad needle, etc., a polishing method by means of cutting, etc., and ultrasonic cleaning in water, etc. have been conventionally suggested.

Furthermore, Publication of Japanese Patent Application (Tokkai Sho) No. 50-103967 discloses a method in which a pellet is provided on the specific jigs one by one and then washed by ultrasonic cleaning in clean water.

However, the above mentioned conventional impregnated cathodes have the following problems.

(1) In order to manufacture the impregnated cathode having a two-layer structure, it is necessary to use two different kinds of raw material powders or to carry out press molding twice. Consequently, the production process is complicated.

(2) In the method in which a pellet is treated one by one or the raw material powder is classified, the productivity is poor and mass production is difficult.

(3) The method of mechanically removing extra electron emitting materials by using a brush, metallic needle, etc., is difficult to carry out. Furthermore, a treatment is necessary for each pellet, so that mass production is difficult.

(4) The manufacturing process in which the sintered pellets are provided on the specific jig one by one is complicated. It takes not less than 1 hour to perfectly remove extra electron emitting materials by way of only the ultrasonic cleaning method. Consequently mass production is difficult.

SUMMARY OF THE INVENTION

It is the object of the present invention to solve the above mentioned conventional problems and to provide an impregnated cathode and a method of manufacturing the same, which is excellent in initial electron emitting performance, lifetime property, and insulating property and which is suitable for mass production by continuously increasing the porosity of the sintered body of porous metal as the distance in the depth direction from the electron emitting face is increased.

In order to achieve the above mentioned objects, the first impregnated cathode of the present invention has a cathode pellet in which the pore portion of a sintered body of porous metal is impregnated with electron emitting material, wherein the porosity of the sintered body of porous metal is continuously increased as the distance in the depth direction from an electron emitting face is increased.

By the above mentioned impregnated cathode, since no discontinuity of the porosity in the pellet is formed, a reaction generating free Ba proceeds continuously and smoothly all over the pellet. Moreover, since raw material powder having more than one kind of particle sizes need not be used, the manufacturing process can be simplified.

It is preferable in the above mentioned first impregnated cathode that the porosity of an electron emitting face of the sintered body of porous metal is in the range of 12.5 to 25 volume %; the porosity difference between the porosity of a vicinity of the electron emitting face and the porosity of a vicinity of the opposite face to the electron emitting face is in the range of 5 to 25 volume %; and the porosity of the opposite side to the electron emitting face is less than 40 volume %. With such an impregnated cathode, an excellent lifetime property can be obtained.

It is further preferable in the first impregnated cathode that the surface roughness of the electron emitting face of the cathode pellet is in the range of 5 to 20 $\mu$m for the maximum height. With the above mentioned impregnated cathode, the emission property can be enhanced.

Next, according to a first method for manufacturing an impregnated cathode of the present invention, a method for manufacturing an impregnated cathode having a cathode pellet in which the pore portion of a sintered body of porous metal is impregnated with electron emitting material, comprises the steps of press molding metal raw material powder to form a porous substrate, the press molding being conducted after filling the metal raw material powder in a struck-level cartridge and then filling the raw material metal powder in a die by level striking measurement; wherein a contacting face of the cartridge and the die surface has an annular shape and the cartridge has an inclined face in which the end portion of the outside of the cartridge contacts with the die surface.

According to the above mentioned manufacturing method, the level striking measurement can be conducted exactly, so that the particle size distribution of the raw material powder inside the cartridge can be reflected in the particle size distribution of the raw material to be filled in the press die. Consequently, the variation of the porosity of the pellet or manufacturing variation in the amount of impregnation of electron emitting materials can be reduced.

It is preferable in the first method for manufacturing an impregnated cathode that the inner diameter of the annular shape is in the range of 10 to 20 times as large as the diameter of a pellet; the external diameter of the annular shape is in the range of 1.05 to 1.3 times as large as the inner diameter; and the angle that the inclined face makes with the die face is in the range of 40 to 80°.

It is further preferable that an amount of metal raw material powder that is filled in the cartridge is equal to an amount of 200 to 800 cathode pellets.

It is further preferable that the metal raw material powder is heated at temperatures in the range of 50 to 100° C. at the time of level striking measurement and pressing.

It is further preferable that a face at which a punch contacts with metal raw material powder is referred to an electron emitting face; the relative descending speed of the punch to the die is in the range of 0.5 to 5 cm/s, and the pressing time is in the range of 1 to 7 seconds when the punch contacts with metal raw material powder.

Next, according to the second method for manufacturing an impregnated cathode of the present invention, a method for manufacturing an impregnated cathode having a cathode pellet in which the pore portion of a sintered body of porous metal is impregnated with electron emitting material comprises the steps of: press molding metal raw material powder to form a porous substrate; and sintering the porous substrate to form a sintered body of porous metal; wherein the average porosity of the porous substrate after press molding is controlled by adjusting the pressure of press molding, and the average porosity of the sintered body of porous metal after sintering is controlled by adjusting the sintering temperature.

By the above mentioned method for manufacturing the impregnated cathode, it is not necessary to use raw material powder having a different particle sizes and to mold in multilayers. Consequently, the average porosity of the entire pellet can be controlled by the general process.

It is preferable in the second method for manufacturing an impregnated cathode that porosity distribution is controlled by adjusting the descending speed of the punch and the pressing time. By the above mentioned method for manufacturing an impregnated cathode, it is not necessary to use raw material powder having different particle sizes and to mold in multilayers. Consequently, the average porosity of the entire pellet can be controlled by general process.

Furthermore, it is preferable that an average porosity (D volume %) of the porous substrate after press molding and an average porosity (d volume %) of the sintered body of porous metal after sintering has a relationship expressed by the following equation:

$$d+10 \leq D \leq d+20.$$

By the above mentioned method for manufacturing an impregnated cathode, the pellets that ensures a certain amount of impregnation can be manufactured by maintaining the mechanical strength and inhibiting the generation of closed pores.

Next, according to the third method for manufacturing an impregnated cathode of the present invention, a method for manufacturing an impregnated cathode having a cathode pellet in which a pore portion of a sintered body of porous metal is impregnated with electron emitting material comprises the steps of placing the sintered body of porous metal and the electron emitting material in a container for impregnation in such a manner that the electron emitting material contacts with an entire surface of the sintered body of porous metal when the electron emitting materials are melted, and impregnating the pore portion of the sintered body of porous metal with the electron emitting material.

With the above mentioned impregnated cathode, deficiency of impregnation can be prevented. Consequently, stable impregnation can be obtained.

It is preferable in the third method for manufacturing an impregnated cathode that electron emitting materials are filled in the container for impregnation in such a manner that the depth of the electron emitting materials is uniform, and the sintered body of porous metal is located at the middle portion in the direction of the depth of the electron emitting material or located at the top of the electron emitting material.

It is further preferable in the third method that the weight of the electron emitting material to be filled in the container for impregnation is in the range of 10 to 100 times as much as the impregnatable weight of the sintered body of porous metal in the container for impregnation. Herein, impregnatable weight means the total effective weight of emitting material that is carried by the porous sintered bodies, or something similar. By the above mentioned method for manufacturing an impregnated cathode, the variation of the amount of impregnation can be reduced.

It is further preferable in the third method that extra electron emitting materials are removed by shaking a container in which an impregnated cathode pellet and alumina ball are placed and washing by ultrasonic cleaning in water. By the above mentioned method for manufacturing an impregnated cathode, extra electron emitting materials can be removed while inhibiting the fracture rate of the pellet and the variation of the amount of impregnation can be reduced.

DETAILED DESCRIPTION OF THE INVENTION

Hereinafter, one embodiment of the present invention will be explained with reference to the drawings.

Embodiment 1

Figure 1:
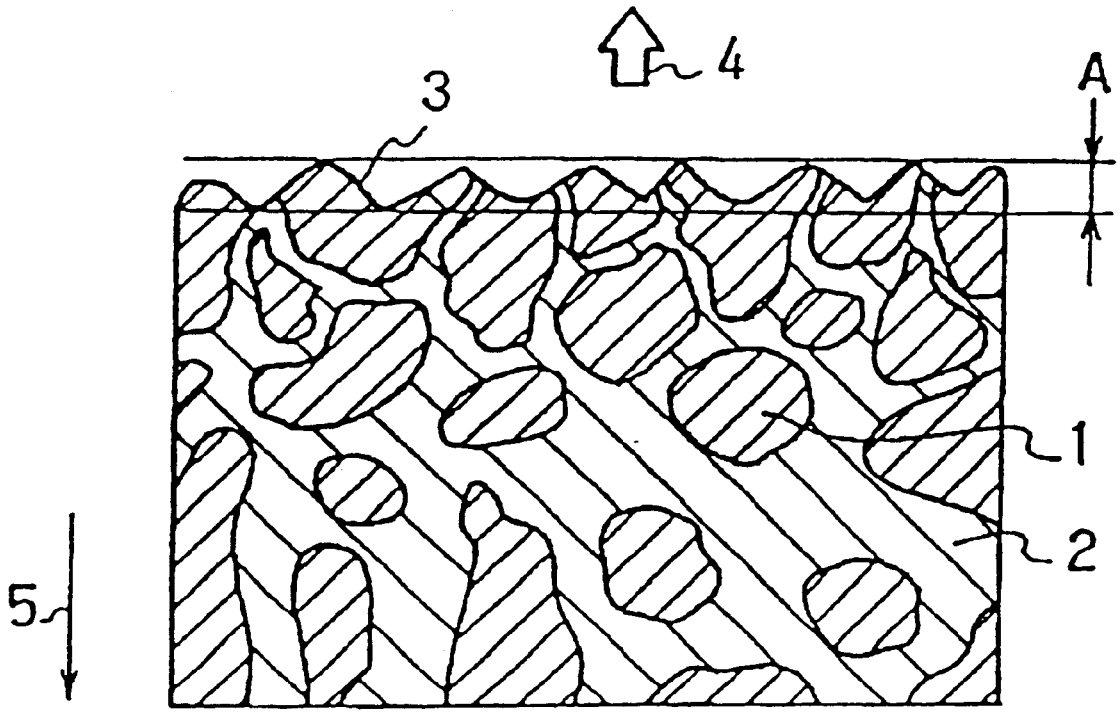
FIG. 1 is a conceptual view of a cross section of an impregnated cathode of one embodiment of the present invention.

FIG. 1 is a conceptual view of a cross section of an impregnated cathode pellet of Embodiment 1 of the present invention. The pellet of this embodiment is a compressed sintered body of metal raw material powder 1. The pellet has pores in it, and the pores are filled with electron emitting materials 2. Arrow 4 illustrates the direction of the electron emission. Porosity is continuously increased along the direction from an electron emitting face 3 to the side opposite to the electron emitting face (the direction expressed by arrow 5). Moreover, the surface roughness A (maximum height) of the electron emitting face 3 is maintained in the range of 5 to 20 $\mu$m.

Figure 2:
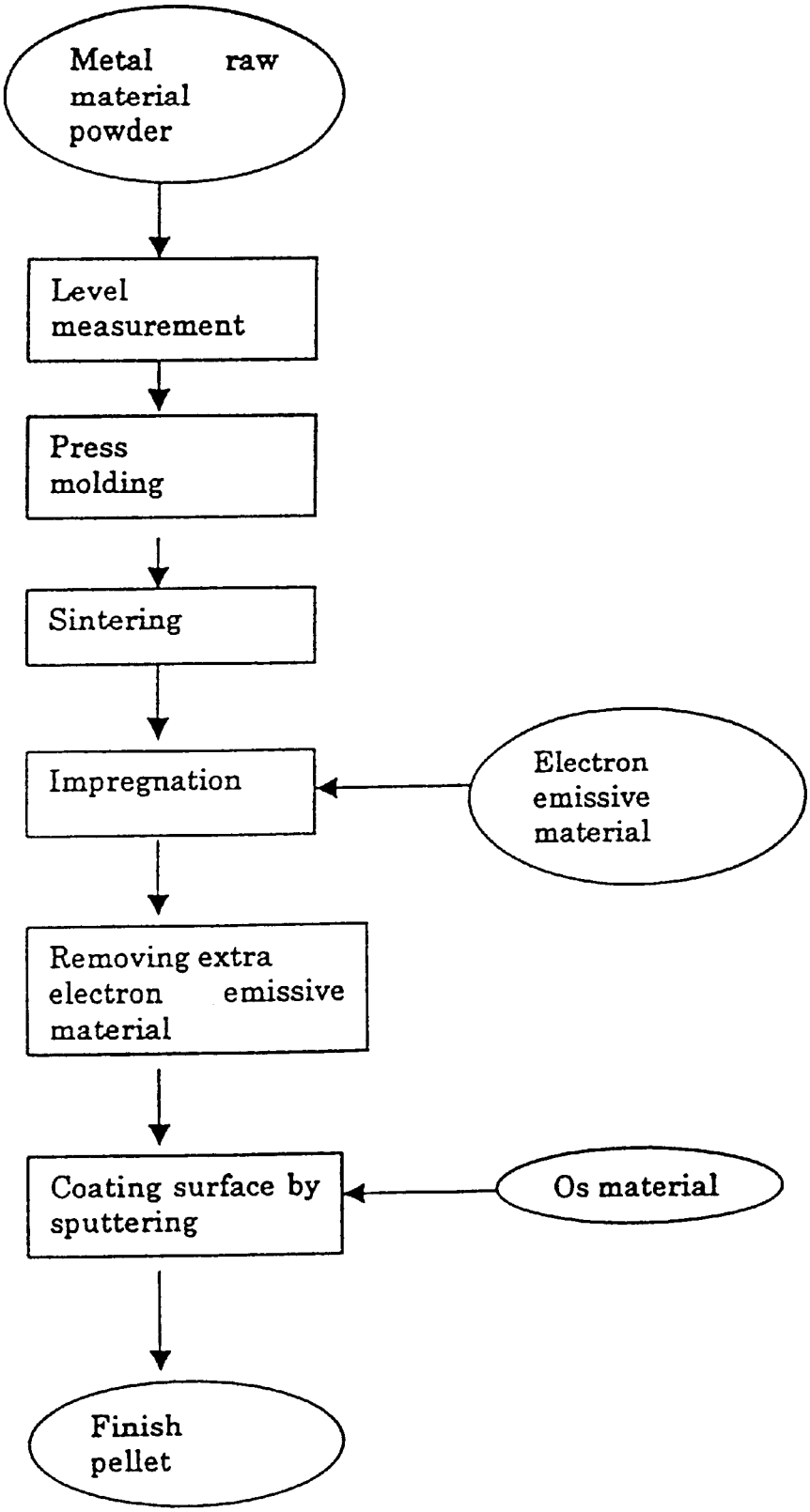
FIG. 2 is a flow chart showing a manufacturing process of an impregnated cathode for one embodiment of the present invention.

FIG. 2 is a flow chart showing a method for manufacturing an impregnated cathode of Embodiment 1. In the process, metal raw material powder is press molded after level striking measurement. The "level striking measurement" means a measurement of the predetermined amount of raw material that is accurately filled in a container by first heaping up the raw material in the container and then striking the raw material level along the edge of the container. The press molded product is sintered in hydrogen or under vacuum at a temperature of 1500 to 2200° C. When the sintered body is heated along with electron emitting materials at the temperature of 1500 to 1800° C., electron emitting materials are melted and impregnated in the pores inside the pellet. Then extra electron emitting materials attached to the pellet are removed. Thus, a pellet is completed by way of a surface coating process.

Figure 3:
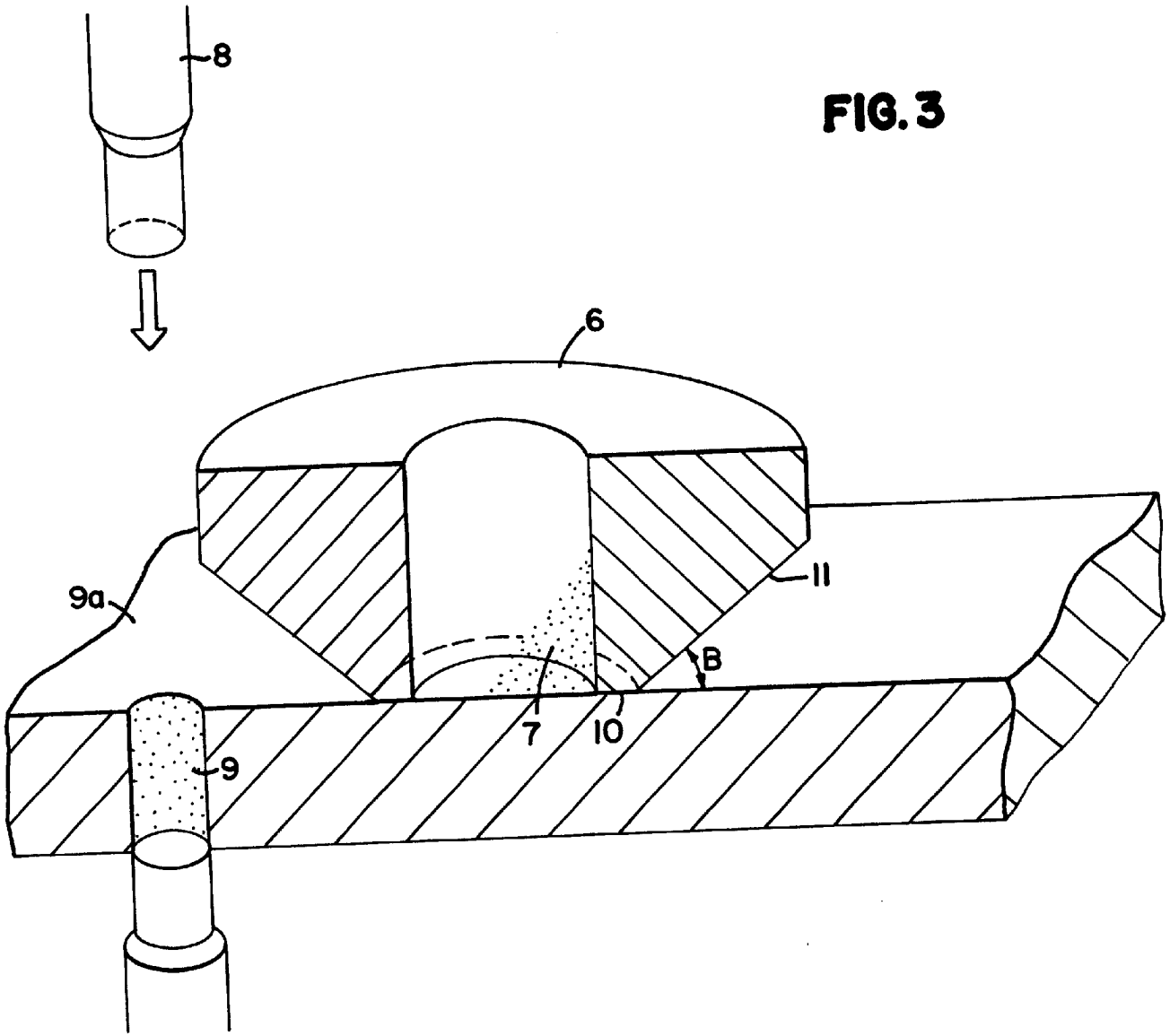
FIG. 3 is a sectional view of a press die and a cartridge for level striking measurement (a cartridge for striking the top surface of the press die and the height of the raw material powder level) used for a method for manufacturing an impregnated cathode of the present invention.

Hereinafter, one example of the method for manufacturing the impregnated cathode of Embodiment 1 will be explained in detail. First, a level striking measurement of raw material powder was carried out. FIG. 3 shows a cartridge for striking the upper surface of metal raw material powder and the die level (hereinafter "cartridge" will be used for an abbreviation) and a press die used in the method for manufacturing an impregnated cathode of this embodiment. As a raw material for a porous substrate, tungsten powder having a particle size of 1 to 10 $\mu$m was used. 3.5 g of raw material powder 7 was filled in a cartridge 6 on the surface 9*a* of the press die. This amount is equal to an amount of about 500 pellets.

The face 10 of the struck level of the cartridge 6 had an annular shape having an inner diameter of 20 mm and an outer diameter of 22 mm, and had an angle B, which the external side face 11 of the cartridge 5 makes with the surface 9*a* of the press die, of 60°. Level measurement was carried out 2 to 6 times while heating the raw material powder 7 at about 80° C. by means of a heater, and 7mg of raw material powder 7 was filled in a through hole portion 9 of the press die. Next, press molding was carried out with a common punch 8. The descending speed of the punch 8 was controlled to 1 cm/s, and the pressing time was 4 seconds.

In order to make the average porosity of the sintered pellet 20% at the temperature in the range of 1850 to 2000° C., press load was controlled in the range of $2\times10^8$ to $10\times10^8$ N/m$^2$ so that the average porosity after press molding was about 35%.

In the following sintering step, sintering was conducted in reducing atmosphere for about 2 hours. The porosity of the pellet manufactured by way of the above mentioned steps was 17 volume % (vol. %) in the electron emitting face that contacts with the punch, 23 vol. % in the opposite side to the electron emitting face and the average of these porosities was 20 vol. %. Moreover, as to the surface roughness of the electron emitting face 3, the maximum height was in the range of 5 to 10 $\mu$m.

Furthermore, the average porosity can be controlled by adjusting the press load and sintering temperature. The spatial distribution of the porosity can be controlled by adjusting the descending speed of the punch and pressing time.

Herein, the porosity and the method for evaluating the porosity are explained. The porosity can be calculated by the following equation, by measuring volume V (cm$^3$) and weight W (g); and using a bulk density of metal raw material $\rho$(g/cm$^3$).

Porosity of the pellet (vol. %)=$[(V-W/\rho)/V]\times100$

Moreover, the porosity distribution in the pellet can be evaluated by the following equations by using d1, d2 and d3. The d1, d2 and d3 denote the average porosity of each of the sectional portions obtained by dividing the pellet into three parts. Therein, these parts are obtained by cutting the pellet with a cut face parallel to the electron emitting face in the direction perpendicular to the electron emitting face.

Porosity of the electron emitting face=d1−(d2−d1)/2

Porosity of the opposite side=d3+(d3−d2)/2

Herein, d1 denotes an average porosity of the sectional portion at the side of the electron emitting face among the three divided portions of the pellet; d2 denotes an average porosity of the sectional portions in the middle portion among the three divided portions of the pellet; and d3 denotes an average porosity of the sectional portion at the side opposite to the electron emitting face among the three divided portions of the pellet.

Herein, the dividing number is not limited to 3. It may be 2 and also 4 or more. The porosity distribution can be evaluated mathematically by calculating by the above mentioned equations.

Next, the impregnation of electron emitting material was carried out. A mixture comprising $BaCO_3$, $CaCO_3$, and $Al_2O_3$ in the mole ratio of 4:1:1 was used as electron emitting material. The electron emitting materials are filled in a cylindrical container for impregnation having a diameter of about 1.5 cm and a depth of about 1 cm. The filled weight of the electron emitting material was about 30 times as much as the weight of that to be impregnated in the porous substrate. 100 sintered porous substrates were provided with the electron emitting materials.

The container for impregnation was placed in a furnace at the temperature of 1500 to 1800° C. in reducing atmosphere. Consequently, the porous substrate was impregnated with the molten electron emitting materials. Moreover, since $BaCO_3$ and $CaCO_3$ are previously decomposed into oxides BaO and CaO respectively, the pellet is impregnated with these oxides.

Next, extra electron emitting materials attached to the surface of the porous substrate were removed. This removal was carried out as follows: the impregnated pellet was placed in a small container along with six alumina balls having a diameter of $\phi$5 mm and shaken for about 5 minutes. Then, the impregnated pellet was cleaned by ultrasonic cleaning in water for about 5 minutes and finally dried, and thus the pellet was completed.

In addition, Os thin film was formed on the electron emitting face of the manufactured porous substrate, i.e. the side contacting with press punch by the sputtering method. The cathode was completed by way of the above mentioned steps. This cathode is incorporated into, for example, the electron gun of a 17" cathode ray tube. This cathode can have a current density of 2 to 4 A/cm$^2$ as the continuous electron emitting on performance at the normal operation temperature of 1000° C. And the cathode has several tens of hundreds hours for an emission lifetime.

In the above mentioned pellet of the present invention, a face of discontinuity of the porosity was not formed in the pellet. Consequently, a chemical reaction generating free Ba proceeds continuously and smoothly on the entire pellet. Furthermore, since it is not necessary to use raw material powder having more than one particle size distribution, it can provide a manufacturing method that is simplified and that is suitable for mass production.

Embodiment 2

In Embodiment 2, the porosity and the porosity distribution of the pellet manufactured by the method of Embodiment 1 were conducted for certain ranges. Various kinds of pellets were manufactured in the manufacturing process explained in Embodiment 1, wherein the porosity of the electron emitting face and the porosity difference between the porosity of the electron emitting face and the porosity of the opposite face ("porosity difference" will be used hereinafter) were varied. These -pellet were completed as cathodes and incorporated into the commercially available 17" cathode ray tube for monitoring. A forced accelerated life test was conducted at the cathode operation temperature of 1250° C. while 400 $\mu$A of direct current per cathode was taken out as an emission.

The measurement results of an initial saturation emission current of the above mentioned various kinds of pellets ("saturation current" will be used hereinafter), an initial amount of evaporation of the electron emitting materials per unit time ("evaporation amount" will be used hereinafter), and an emission lifetime ("lifetime" will be used hereinafter) are shown in Table 1. In Table 1, the values of the saturation current, evaporation amount and lifetime are relative values, with the respective measurement values being 1 when the porosity of the electron emitting face was 20 vol. % and the porosity difference was 0.

Figure 4:
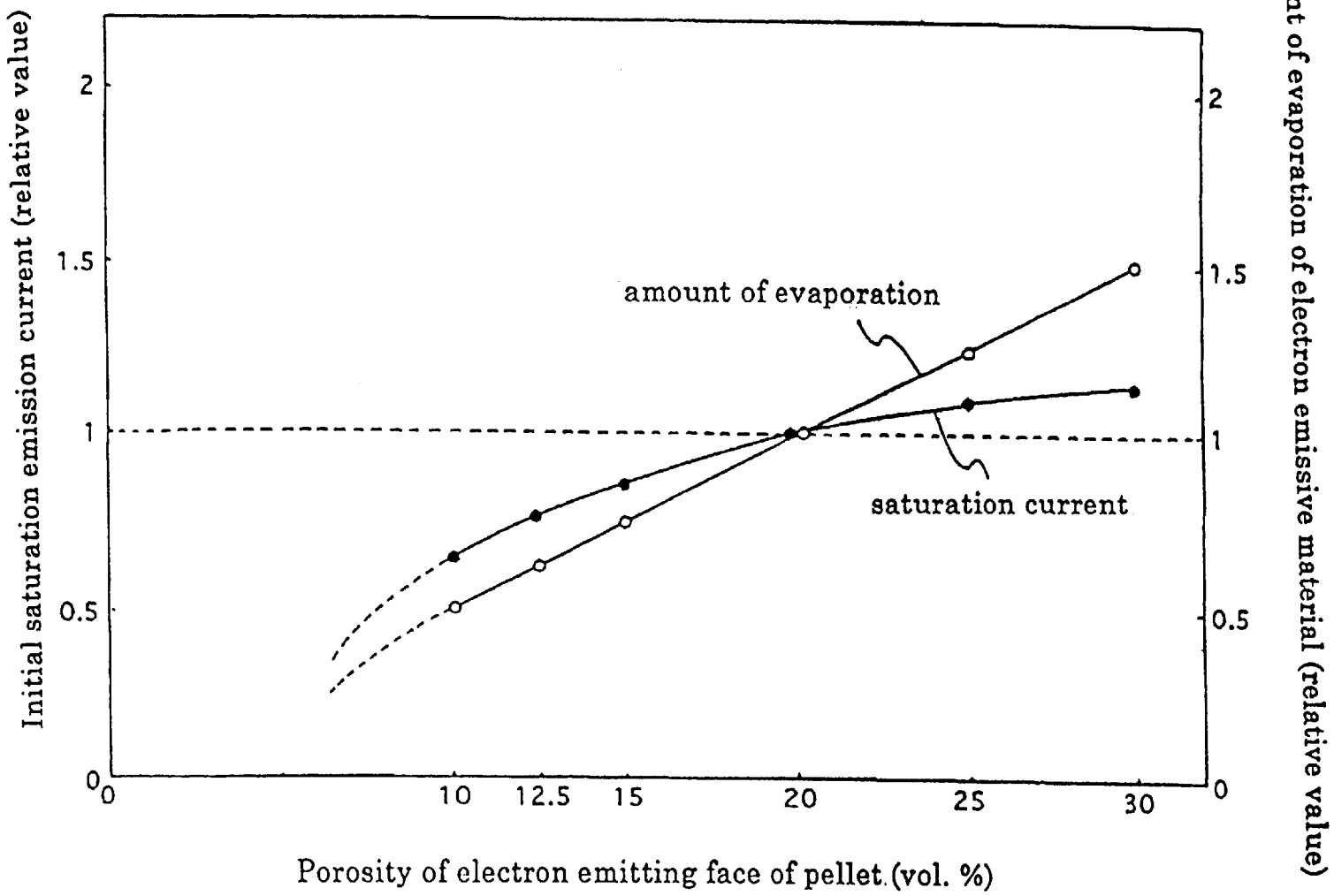
FIG. 4 is a graph showing the relationship between the porosity of an electron emitting face and the saturation current and the relationship between the porosity of an electron emitting face and the evaporated amount of an impregnated cathode of one embodiment of the present invention.
Figure 5:
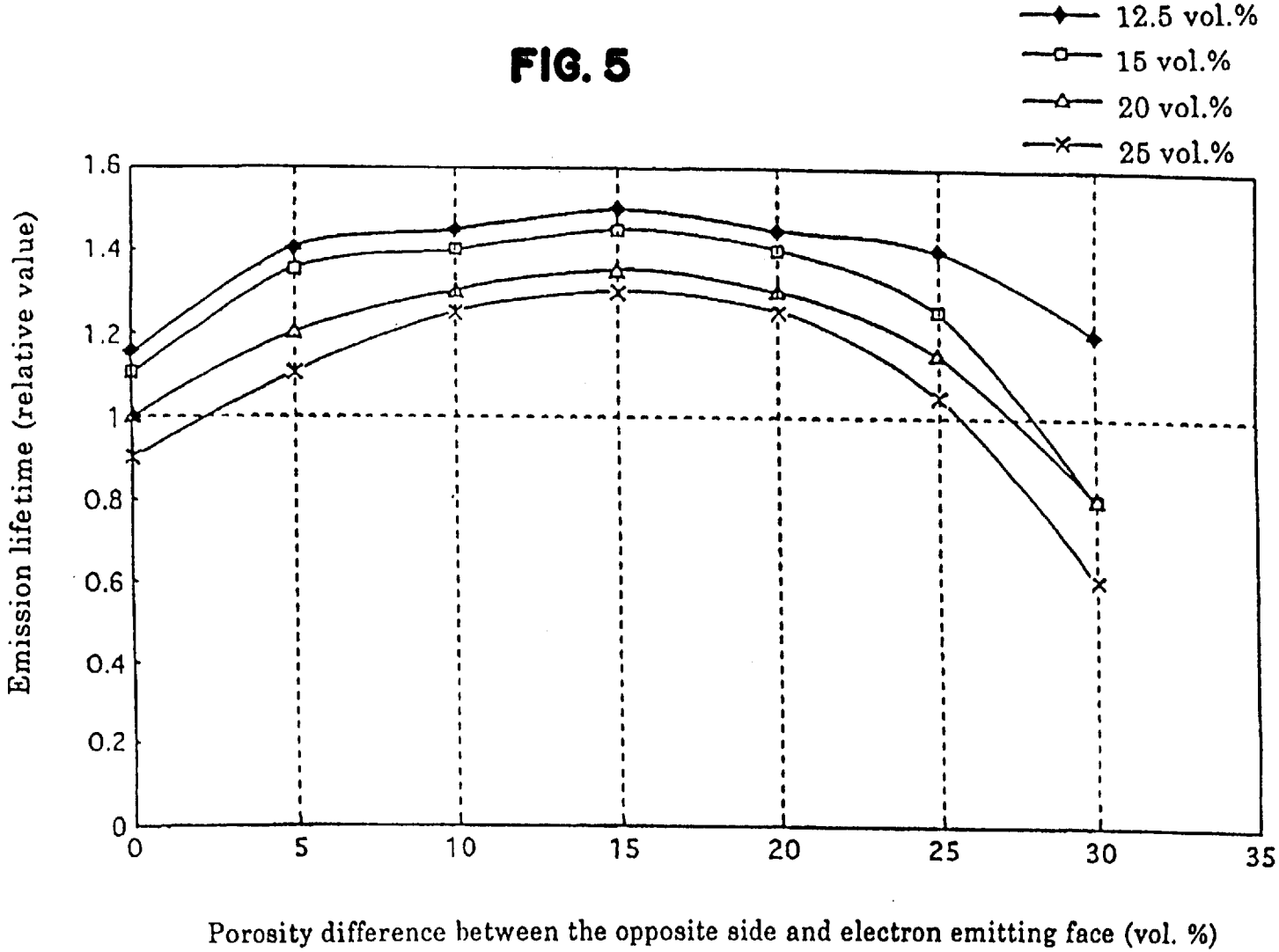
FIG. 5 is a graph showing the relationship between the porosity difference and the lifetime of an impregnated cathode of one embodiment of the present invention.

Furthermore, FIG. 4 is a graph showing the relationship between the porosity of an electron emitting face and the saturation current and the relationship between the porosity of an electron emitting face and the evaporation amount. Similarly, FIG. 5 is a graph showing the relationship between the porosity difference and the lifetime.

TABLE 1

| Porosity of an electron emitting face | Evaluation | Porosity difference between the opposite side and the side of an electron emitting face (vol. %) | | | | | | |
|---|---|---|---|---|---|---|---|---|
| (vol. %) | Items | 0 | 5 | 10 | 15 | 20 | 25 | 30 |
| 10 | A | 0.65 | 0.65 | 0.65 | 0.65 | 0.65 | 0.65 | 0.65 |
| | B | 0.5 | 0.5 | 0.5 | 0.5 | 0.5 | 0.5 | 0.5 |
| | C | 1.2 | 1.4 | 1.5 | 1.6 | 1.7 | 1.7 | 1.5 |
| | D | 10 | 12.5 | 15 | 17.5 | 20 | 22.5 | 25 |
| 12.5 | A | 0.75 | 0.75 | 0.75 | 0.75 | 0.75 | 0.75 | 0.75 |
| | B | 0.6 | 0.6 | 0.6 | 0.6 | 0.6 | 0.6 | 0.6 |
| | C | 1.15 | 1.4 | 1.45 | 1.5 | 1.45 | 1.4 | 1.2 |
| | D | 12.5 | 15 | 17.5 | 20 | 22.5 | 25 | 27.5 |
| 15 | A | 0.85 | 0.85 | 0.85 | 0.85 | 0.85 | 0.85 | 0.85 |
| | B | 0.75 | 0.75 | 0.75 | 0.75 | 0.75 | 0.75 | 0.75 |
| | C | 1.1 | 1.35 | 1.4 | 1.45 | 1.4 | 1.25 | 0.8 |
| | D | 15 | 17.5 | 20 | 22.5 | 25 | 27.5 | 30 |
| 20 | A | 1 | 1 | 1 | 1 | 1 | 1 | 1 |
| | B | 1 | 1 | 1 | 1 | 1 | 1 | 1 |
| | C | 1 | 1.2 | 1.3 | 1.35 | 1.3 | 1.15 | 0.8 |
| | D | 20 | 22.5 | 25 | 27.5 | 30 | 32.5 | 35 |
| 25 | A | 1.1 | 1.1 | 1.1 | 1.1 | 1.1 | 1.1 | 1.1 |
| | B | 1.25 | 1.25 | 1.25 | 1.25 | 1.25 | 1.25 | 1.25 |
| | C | 0.9 | 1.1 | 1.25 | 1.3 | 1.25 | 1.05 | 0.6 |
| | D | 25 | 27.5 | 30 | 32.5 | 35 | 37.5 | 40 |
| 30 | A | 1.15 | 1.15 | 1.15 | 1.15 | 1.15 | 1.15 | 1.15 |
| | B | 1.5 | 1.5 | 1.5 | 1.5 | 1.5 | 1.5 | 1.5 |
| | C | 0.6 | 0.7 | 0.8 | 0.6 | 0.4 | 0.3 | 0.2 |
| | D | 30 | 32.5 | 35 | 37.5 | 40 | 42.5 | 45 |

A: saturation current
B: amount of evaporation
D: lifetime
D: average porosity

Table 1, and FIGS. 4 and 5 show the following things.

(i) If the porosity of the electron emitting face is kept constant, the saturation current and amount of evaporation are constant regardless of the average porosity.

(ii) If the porosity of the electron emitting face is varied, as shown in FIG. 4, the saturation current is slowly increased in accordance with the increase of the porosity of the electron emitting face and saturated when the porosity of the electron emitting face is around 30 vol. %.

(iii) On the other hand, the evaporation amount is increased approximately in proportion with the porosity of the electron emitting face, so that when the porosity of the electron emitting face is increased more than the predetermined value, unnecessary electron emission may be increased at the electrode of the electron gun. Therefore, in practice, it is necessary to compromise the saturation current and amount of evaporation. More specifically, it is preferable that the porosity of the electron emitting face is in the range of 12.5 to 25 vol. %.

(iv) As shown in FIG. 5 and Table 1, when the porosity difference is in the range of 5 to 25 vol. %, the lifetime is extended in the range of 10 to 40 % as compared with the lifetime where there is no porosity difference.

Moreover, not shown in Table 1, when the porosity of the side opposite to the electron emitting face is not less than 40 vol. %, the mechanical strength of the pellet is weakened. Therefore, it is preferable in practice that the porosity of the opposite side to the electron emitting face be less than 40 vol. %.

According to above mentioned results, the effective choice of the porosity and porosity distribution: in the range of 12.5 to 25 vol. % for the porosity of the electron emitting face; in the range of 5 to 25 vol. % for the porosity difference; and less than 40% for the porosity of the side opposite to the electron emitting face.

The above mentioned effective choice can be expressed as follows:

$$15 \leqq \rho \leqq 30 \quad \text{(Equation 1)}$$

$$5 \leqq \Delta\rho \leqq 25 \quad \text{(Equation 2)}$$

$$\Delta\rho < 2\times(40-\rho) \quad \text{(Equation 3)}$$

$$\Delta\rho \leqq 2\times(\rho-12.5) \quad \text{(Equation 4)}$$

wherein the average porosity is ρ vol. % and the porosity difference is Δρ vol. %.

The lower limit value of Equation 1, 15 vol. % was determined from the fact that the lower limit value in the preferable range of the porosity of the electron emitting face was 12.5 vol. % and the lower limit value of the preferable range of the porosity difference was 5. vol. %. The upper limit of the Equation 1, 30 vol. % was determined as the maximum value at Table 1, which satisfied the below mentioned conditions where the upper limit value in the preferable range of the porosity of the electron emitting face was 25 vol. % and the porosity of the opposite side to the electron emitting face was less than 40 vol. %.

Equation 3 was determined from the condition where the porosity of the opposite side to the electron emitting face was less than 40 vol. %. Equation 4 was determined from the condition where the porosity of the electron emitting face was not less than 12.5 vol. %.

Figure 6:
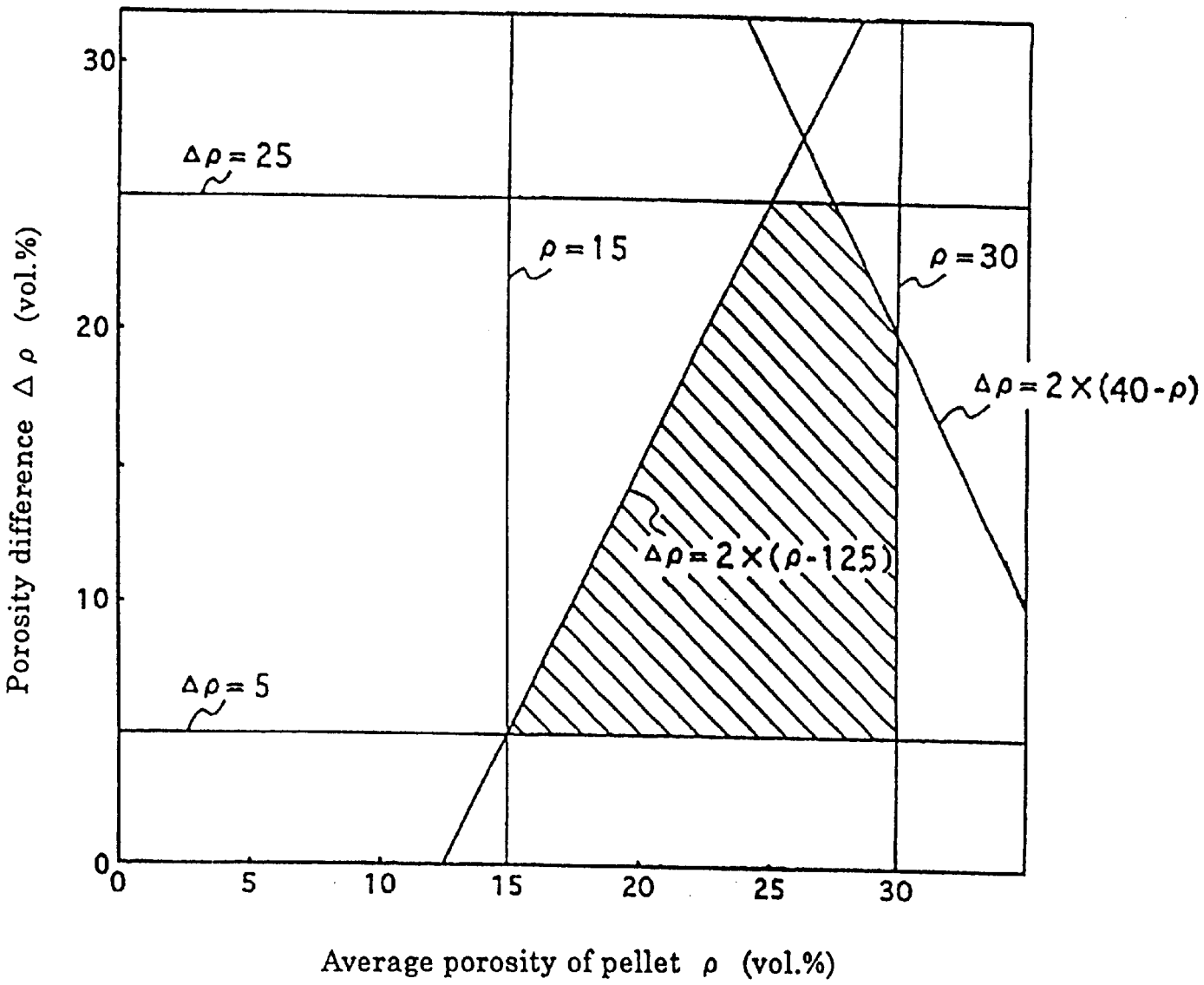
FIG. 6 is a graph showing the relationship between the average porosity and the porosity difference of an impregnated cathode of one embodiment of the present invention.

FIG. 6 shows the relationship of Equations 1 to 4. The hatched portion of FIG. 6 shows the range satisfying Equations 1 to 4. In other words, if the average porosity ρ and the porosity different Δρ of the pellet are selected from the hatched portion of FIG. 6, an excellent lifetime property can be obtained. Furthermore, when the necessary emission and amount of evaporation are selected from this range, the best pellet design is possible.

Embodiment 3

Figure 7:
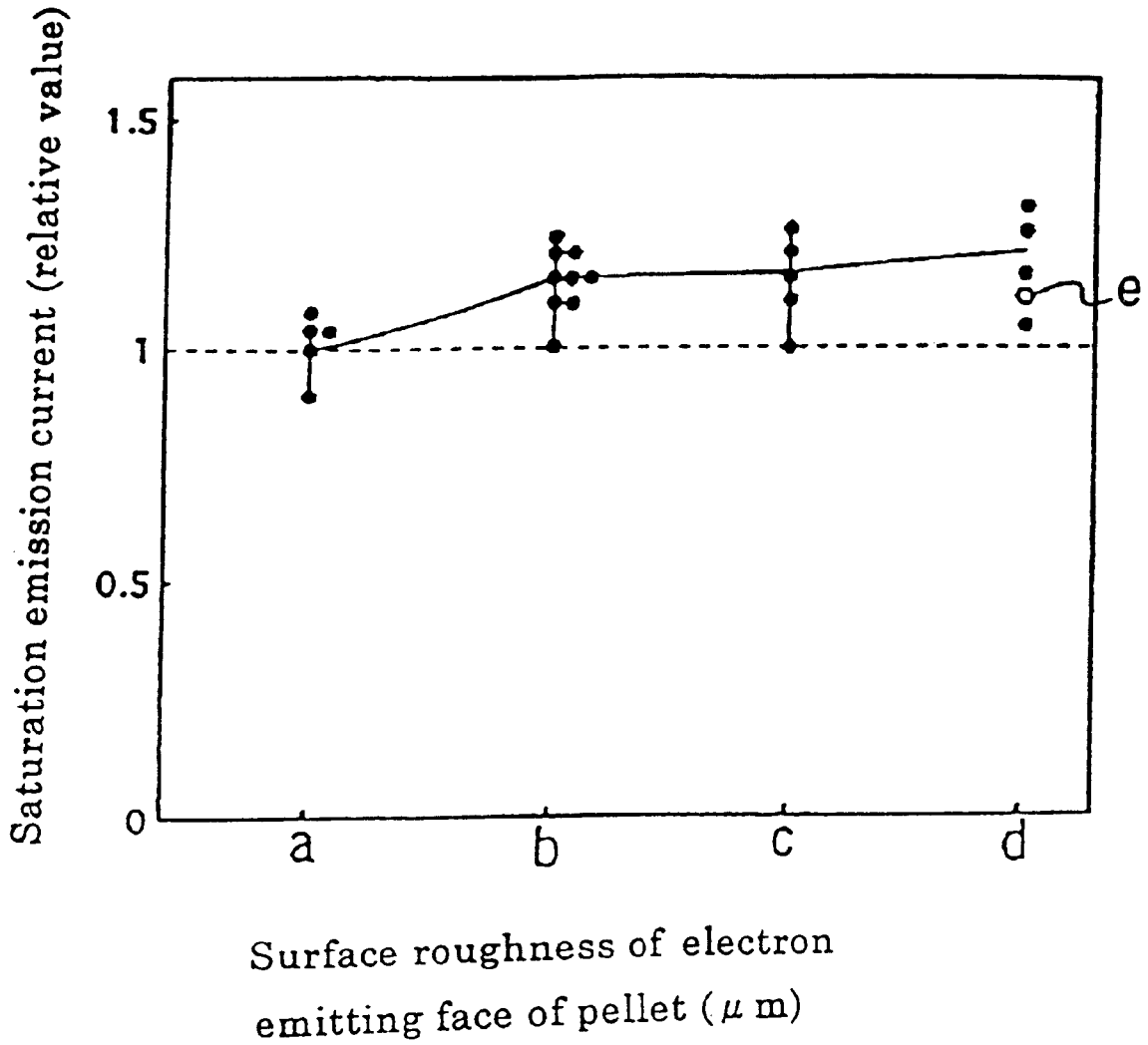
FIG. 7 is a graph showing the relationship between the surface roughness of an electron emitting face and the relative value of the saturation current of an impregnated cathode of one embodiment of the present invention.

In Embodiment 3, the emission property was enhanced by forming a certain range of surface roughness on the electron emitting face of the pellet. FIG. 7 shows the relationship between the surface roughness and the relative value of the saturation current. The saturation current was measured by making a trial manufacture of the pellet as a usual cathode. The relative values shown by the vertical axis of FIG. 7 are expressed based on the value of 1 at the pellet having a surface roughness of the electron emitting face of 0 μm.

The horizontal axis of FIG. 7 shows the surface roughness of the electron emitting face of the pellet. The measurement was conducted for four kinds of pellets classified based on the range of the surface roughness. More specifically, the range of the surface roughness at the points a to d are: 0 to 5 μm for point a; 5 to 10 μm for the point b; 10 to 20 μm for the point c; and 20 to 30 μm for the point d. The surface roughness represents the maximum height.

FIG. 7 shows that as the surface roughness is increased, the relative value of the saturation current is increased and the pellet becomes more excellent. The relative values of the saturation current at any of the points b, c, and d are not less than 1. However, at the point d, sparks were found to be generated between the facing anode in some cases (the point e of FIG. 7). Therefore, the points b and c of FIG. 7 are preferred. In other words, from the viewpoint of inhibiting sparks and maximizing the emission, it is preferred that the surface roughness is in the range of 5 to 20 μm.

Moreover, in the above mentioned measurement, the pellet having a porosity of the electron emitting face of 17 vol. %, and porosity difference of 6 vol. % was used. However, if the pellet having the other values is used, the relationship between the surface roughness and saturation current is similar. It is preferable that the surface roughness is in the range of 5 to 20 μm.

Furthermore, since the pellet that is manufactured by the basic process explained in Embodiment 1 has the surface roughness of 5 to 10 μm, its surface was mechanically abraded to form the pellet having a surface roughness of 0 to 5 μm. Moreover, the pellet having a surface roughness of 10 to 30 μm was manufactured by sintering by attaching tungsten powder of about 10 to 20 μm to the surface of the substrate after press molding.

Embodiment 4

The most important thing for mass production of cathode pellets is to reduce the variation of the porosity per pellet and to stabilize the amount of electron emitting materials. In the basic process explained in Embodiment 1, the embodiments for reducing the variation in manufacturing will be explained with reference to the following Embodiments 4 to 11.

Embodiment 4 refers to the shape of the cartridge used for the press molding process. The optimum shape of the cartridge of Embodiment 4 will be explained. It is important for a cartridge 6 to precisely reflect the particle distribution of the raw material powder 7 on the particle size distribution of raw material powder to be filled in the press die.

Therefore, the shape and size of the contacting surface 10 between the cartridge 6 and the surface 9*a* of the press die are important. More specifically, it is preferable that the shape of the contacting surface 10 is an annular shape. If the shape is an annular shape, in the reciprocating motion of striking level, stirring of raw material powder can be conducted in the cartridge 6.

If the shape of the contacting face is square, even if the reciprocating motion is conducted, the two dimensional stirring of powder in the horizontal direction of the press die cannot be expected. If the cartridge 6 is set in such a manner that diagonal lines of square shape, etc. is made to pass the through hole 9, two dimensional stirring can be expected. In this case, however, since the corner portions of the cartridge 6 contact with the end portion of the through hole 9, the cartridge 6 and press die are damaged.

It is preferable that in a case where the contacting face 10 is annular in shape, the inner diameter of the circle is 10 to 20 times as large as the inner diameter of the through hole 9 (the diameter of the pellet). If the inner diameter of the circle is less than 10 times as large as the inner diameter of the through hole 9, stirring effect of powder is lowered. As a result, a pellet whose particle distribution becomes rougher as pressing is conducted is manufactured. Moreover, if the inner diameter of the circle is more than 20 times as large as the inner diameter of the through hole, the stirring effect is further enhanced, but a stroke of the reciprocating motion is longer. Consequently, the mass production capability is deteriorated.

It is preferable that the outer diameter of the circle is in the range of 1.05 to 1.3 times as large as the inner diameter. If the outer diameter is less than 1.05 times as large as the inner diameter, one-sided reduction occurs due to its contacting with press die, so that the cartridge cannot be used for a long time. Moreover, if the outer diameter is more than 1.3 times as large as the inner diameter, the adhesiveness between the annular portion and the surface 9*a* of the press die is poor, so that the level striking measurement cannot exactly be conducted. In addition, fine powder can enter the gap of the contacting face 10, so that level striking measurement cannot be conducted.

An external face 11 of the cartridge that contacts with the outer diameter of the circle is preferably an inclined face. An angle B that the external face 11 makes with the contacting face is preferably in the range of 40 to 80°. If the angle is less than 40°, raw material powders are involved at the time of the level striking operation, so that measurement sometimes becomes inaccurate. On the other hand, if the angle is more than 80°, raw material powders are held at the time of contacting the end portion of the though hole 9 and the cartridge 6, so that a smooth level striking operation cannot be conducted.

Embodiment 5

Figure 8:
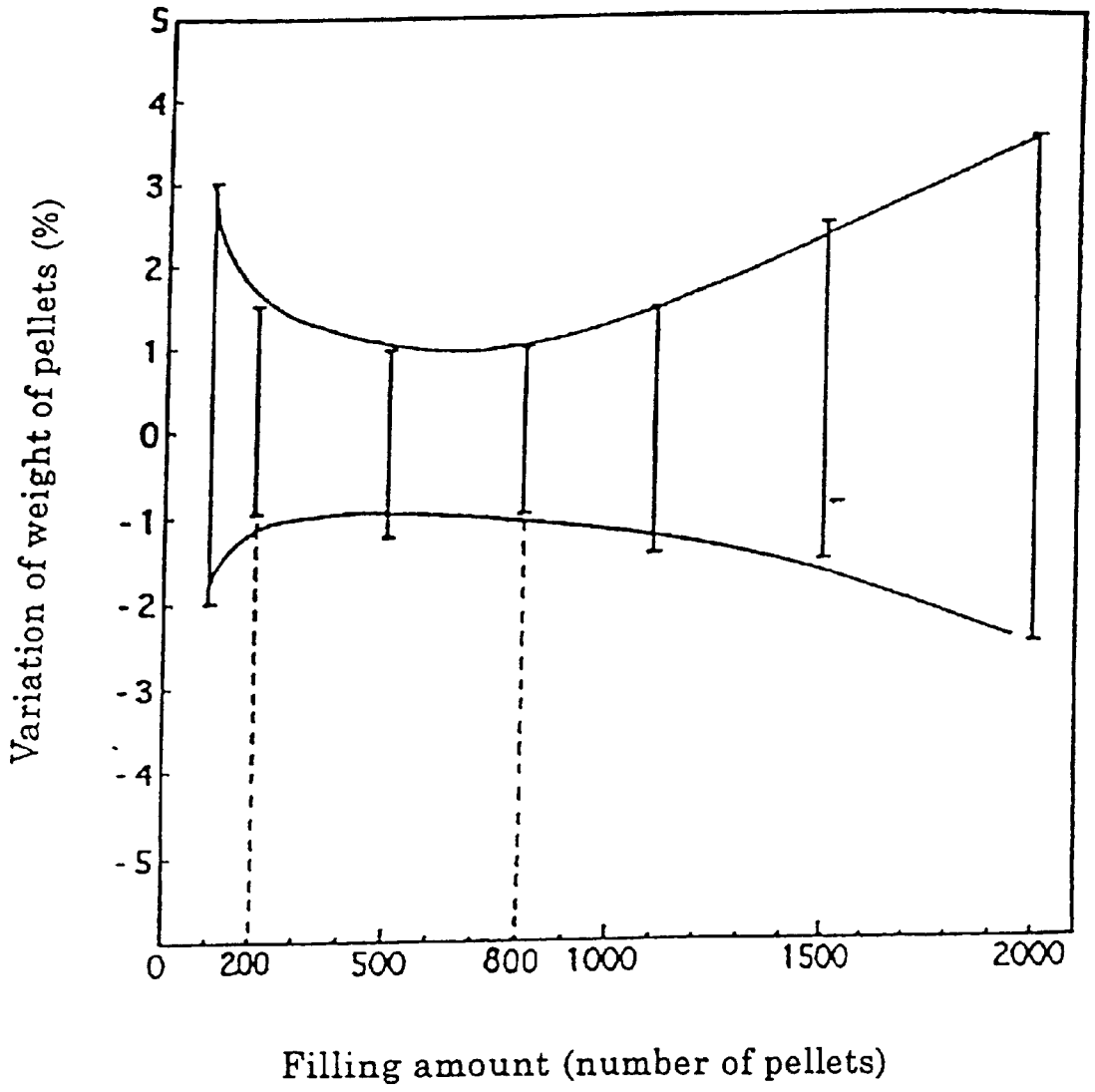
FIG. 8 is a graph showing the relationship between the filling amount of metal raw material powder and the variation of the weight of the pellet of an impregnated cathode of one embodiment of the present invention.

Embodiment 5 refers to a manufacturing method in which an amount of metal raw material powder filled in the cartridge of metal is made to be in the certain range of amount. FIG. 8 shows the relationship between a filling amount of metal raw material powder and the variation of the pellet weight. In order to obtain the measurement results of FIG. 8, the pellet was manufactured by varying the filling amount of the tungsten powder from the an amount corresponding to the weight of 100 pellets (about 0.7 g) to the weight of 2000 pellets (about 14 g). Powder corresponding to the decreased amount of powder is supplemented each time 100 pellets were manufactured. 10000 pellets were manufactured under one certain standard.

The vertical axis of FIG. 8 represents the weight of metal raw material powder, which corresponds to the weight of metal raw material filled in the cartridge. In other words, the weight of metal raw material powder is expressed by the number of the pellets. The variation of weight was measured for the manufactured pellet after press molding.

According to FIG. 8, it is found that when the filling amount corresponds to the weight of 200 to 800 pellets, the pellet weight is stable. However, when the filling amount exceeds this range, the variation gradually is increased. This is because if the filled weight is appropriate, the powder inside the cartridge is appropriately stirred due to the level striking operation and powders are filled in the through hole of the press die while the particle distribution of the powder body is maintained.

Embodiment 6

Embodiment 6 refers to a manufacturing method in which the heating temperature of the raw material powder at the time of press molding is made to be in the certain range. In order to enhance the stirring effect of the raw material powder inside the cartridge and to reduce the variation of the porosity of the pellet and the weight, it is necessary to ensure an excellent particulate flow. Fine powders adsorb the humidity in air, so that the particulate flow becomes poor. Therefore, the fine powders are preferably heated at temperatures in the range of 50 to 100° C. before they are filled in the press die.

If the heating temperature exceeds 100° C., platinum group/noble metal, for example tungsten, is affected by an oxidation by air, which is not preferred for manufacturing pellets. On the other hand, if the heating temperature is less than 50° C., the dehumidification effect by heating is low.

Figure 9:
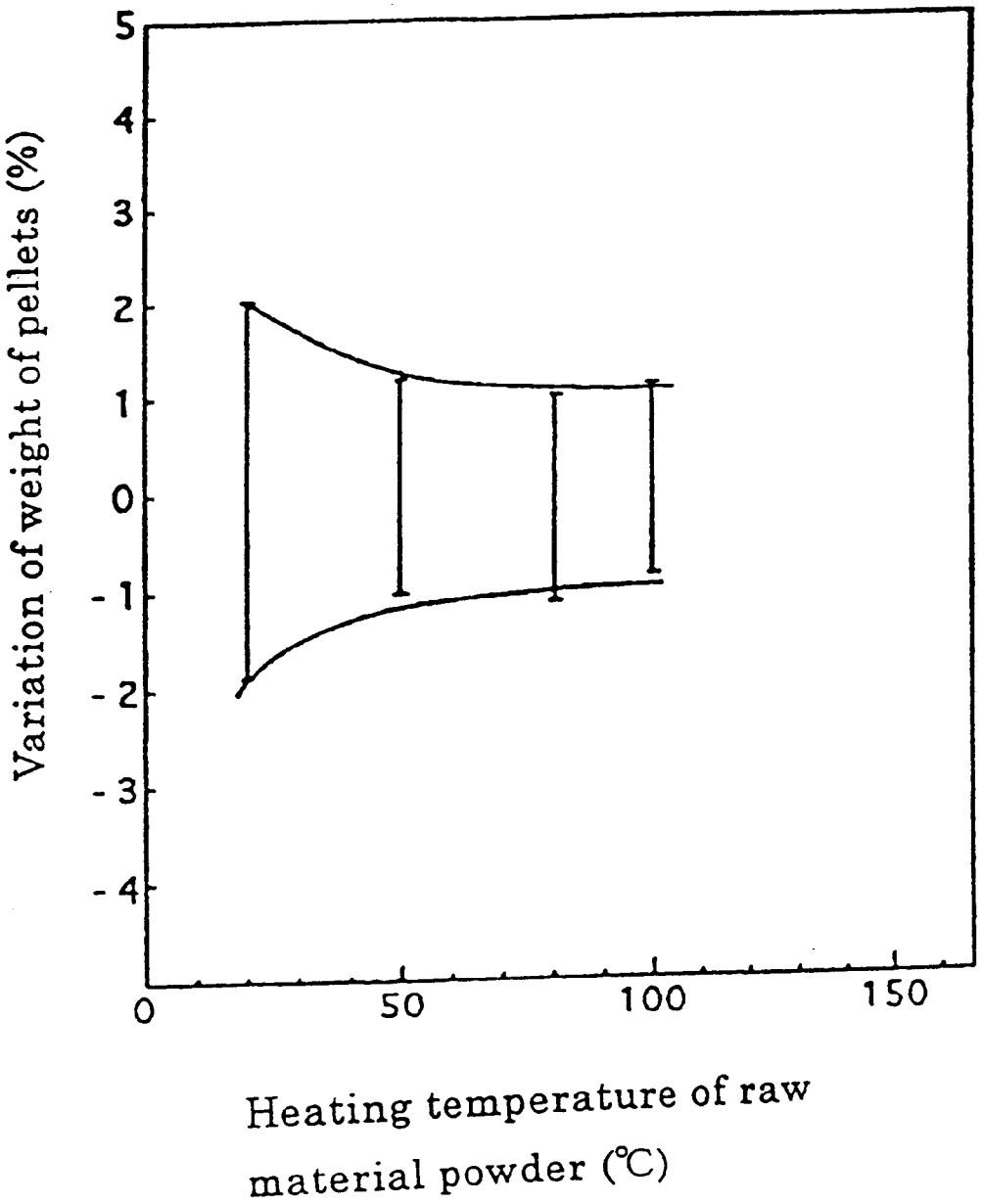
FIG. 9 is a graph showing the relationship between the heating temperature of the raw material powder and the variation of the weight of the pellet of an impregnated cathode of one embodiment of the present invention.

FIG. 9 shows the relationship between the temperature at which raw material powder is heated and the variation of the pellet weight. The filling amount of raw material powder filled in a struck-level cartridge is made to be the weight corresponding to the weight of 500 pellets. The heating was conducted by a lamp. FIG. 9 shows that when the heating temperature is in the range of 50 to 100° C., the weight of the pellet is stable.

Embodiment 7

Embodiment 7 refers to a manufacturing method in which the descending speed of punch and the pressing time at the time of press molding are made to be in the certain range. In the press molding, the descending speed of punch and the pressing time are important elements so as to control the porosity distribution.

In the motion of the raw material powder inside the press die during the press molding, the greatest motion of the powder is in the portion that contacts with the punch. Powder at the opposite side hardly moves. Consequently, at the powder in the vicinity of the contacting face, the punch rubs with the press die or rubs between powders, the pressure applied to the punch is consumed, and the pressure cannot easily be transmitted to the vicinity to the opposite side of the contacting face. Therefore, the porosity in the vicinity of the contacting face between the punch and powder is low and the porosity of the opposite side is high.

As mentioned above, when the descending speed of the punch is increased, the incline of the porosity distribution inside the pellet is observed in the direction to which the press pressure is applied. In other words, the porosity difference between the electron emitting face and the opposite face is increased. On the contrary, if the descending speed is reduced, the press can be conducted smoothly while the friction of the raw material powder in the die is inhibited, so that more uniform porosity distribution can be obtained.

Furthermore, as the pressing time is longer, the pressure is liable to be applied uniformly to the entire raw material powder. On the contrary, when the press molding is conducted for a short time, the pressure is applied non-uniformly, and the porosity difference is increased between the electron emitting face and the opposite face.

The measurement results of the porosity difference (vol. %) are shown in Table 2. Herein, the descending speed of the punch and the pressing times are respectively changed and are combined.

TABLE 2

| Pressing | Descending speed (cm/s) | | | | | |
|---|---|---|---|---|---|---|
| time (s) | 0.2 | 0.5 | 1 | 3 | 5 | 7 |
| 0.2 | 10 | 20 | 25 | 35 | 40 | 40 |
| 0.5 | 4 | 10 | 20 | 35 | 40 | 40 |

TABLE 2-continued

| Pressing | Descending speed (cm/s) | | | | | |
|---|---|---|---|---|---|---|
| time (s) | 0.2 | 0.5 | 1 | 3 | 5 | 7 |
| 1 | 3 | 8 | 13 | 29 | 33 | 40 |
| 3 | 3 | 5 | 10 | 25 | 30 | 35 |
| 7 | 2 | 5 | 7 | 18 | 25 | 30 |
| 10 | 2 | 5 | 6 | 16 | 23 | 25 |

According to Table 2, if the descending speed is selected in the range of 0.5 to 5 cm/s, and the pressing time is selected in the range of 1 to 7 seconds, the porosity distribution can be controlled freely. The pressing time that is more than 7 seconds still may be excellent but not suitable for the mass production.

As mentioned above, the average porosity all over the pellet can be independently controlled by adjusting the press pressure. Therefore, the pellet of the present invention easily can be manufactured by a usual process, wherein raw material powder having a different particle distribution is not used, and molding in multilayers is not needed.

Embodiment 8

Embodiment 8 refers to a manufacturing method in which the average porosity of the porous substrate after press molding and the average porosity of the pellet after sintering are in a certain range.

In order to stabilize the impregnation of the electron emitting materials into the pellet, the continuity of the porosity, besides the porosity of the pellet, is important element. In other words, it is important to reduce pores that are not connected to an opening of the pellet surface and to reduce closed pores that are not impregnated with electron emitting materials.

Furthermore, in order to ensure the mass productivity of pellets sufficient mechanical strength is necessary.

Figure 10:
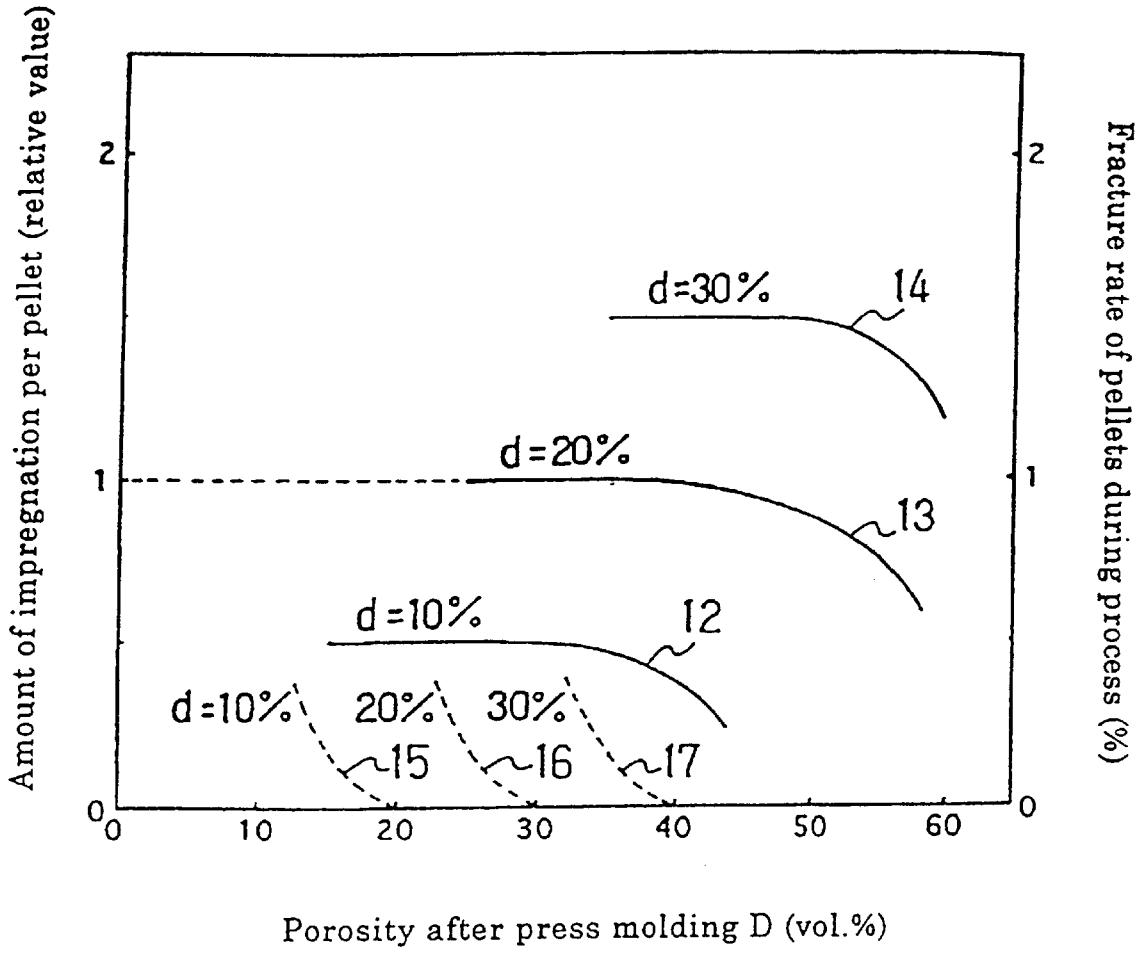
FIG. 10 is a graph showing the relationship between the average porosity of the porous substrate after press molding and the amount of impregnation of electron emitting material and the relationship between the average porosity of the porous substrate after press molding and the fracture rate of the pellet of an impregnated cathode of one embodiment of the present invention.

FIG. 10 is a graph showing the relationship between the average porosity of a porous substrate after press molding and the impregnation amount of the electron emitting materials and the relationship between the average porosity of a porous substrate after press molding and the fracture rate of the pellet. Lines 12 to 14 show the relationship between the average porosity D (vol. %) of the porous substrate after press molding and the amount of impregnation of electron emitting material, in a case where the average porosity d (vol. %) of the pellet after sintering is changed in the range of 10 to 30 vol. %. The left vertical axis shows the relative value of the amount of impregnation per pellet. The amount of impregnation is made to be 1 when the average porosity d after sintering is 20 vol. % and the average porosity D after press molding is 30 vol. %.

The results shown by lines 12 to 14 show that when the average porosity D exceeds the certain value, the amount of impregnation begins to lower. For example, in a line 12 where the average porosity d of the pellet after sintering is 10 vol. %, the amount of impregnation is stable until the average porosity D is 30 vol. %, however, if it is more than 30 vol. %, the amount of impregnation begins to lower.

Lines 15 to 17 show the relationship between the average porosity D (vol. %) of the porous substrate after press molding and the relative value of the fracture rate of pellets in a case where the average porosity d (vol. %) of the pellet after sintering is changed in the range of 10 to 30 vol. %. The right vertical axis shows the fracture rate of the pellets.

The results shown in lines 15 to 17 show that when the average porosity D exceeds the certain value, the fracture rate of the pellet becomes 0. For example, in line 15 where the average porosity d after sintering is 10 vol. %, the fracture rate of the pellet is 0 when the average porosity D is 20 vol. %.

According to the above mentioned measurement results, in order to manufacture the pellet having a certain amount of impregnation while maintaining the mechanical strength and inhibiting the occurrence of the closed pores, it is necessary that the relationship between the average porosity D (vol. %) after press molding and the average porosity d (vol. %) after sintering is expressed in the following equation:

$$d+10 \leqq D \leqq d+20.$$

Figure 11:
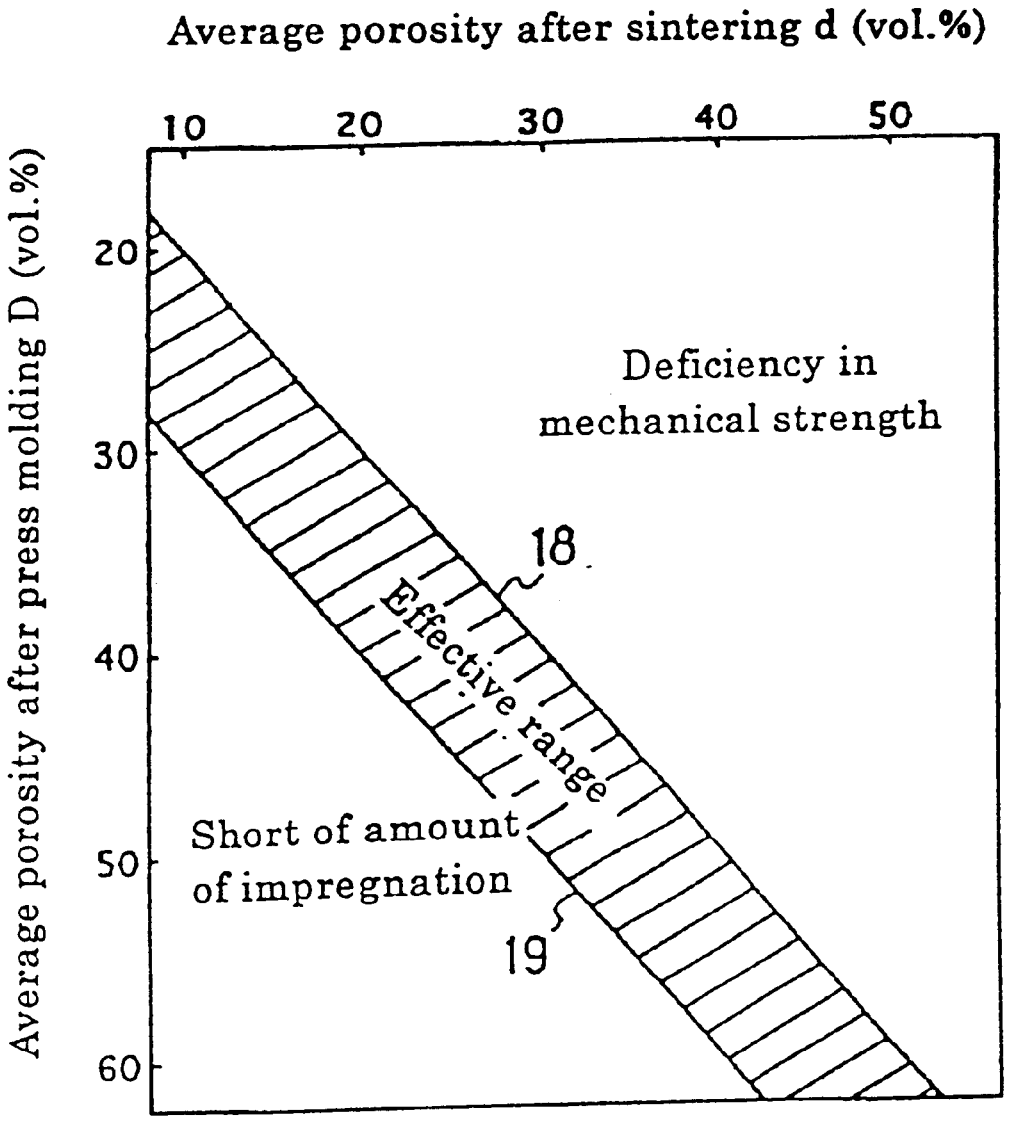
FIG. 11 is a graph showing the relationship between the average porosity after press molding and the average porosity after sintering of an impregnated cathode of one embodiment of the present invention.

The above mentioned expression of the relationship is shown in FIG. 11. Line 18 satisfies the relationship: D=d+10. Line 19 satisfies the relationship: D=d+20. Therefore, the hatched portion between the lines 18 and 19 is the portion that satisfies the above mentioned expression of the relationship. In the portion above the line 18, the mechanical strength is insufficient. On the other hand, in the area below the line 19, the amount of impregnation is too little. For example, if the pellet having the average porosity d of 20 vol. % is desired to be obtained, the average porosity D after press molding is preferably in the range of 30 to 40 vol. %.

In this case, if the average porosity D is less than 30 vol. %, the pellet is hardly sintered, so that the mechanical strength lowers greatly. Consequently, the pellet is fractured when it is handled. On the other hand, if the average porosity is more than 40 vol. %, the pellets are sintered too much. As a result, a great number of closed pores are generated, and an appropriate amount of electron emitting materials cannot be impregnated.

Embodiment 9

Embodiment 9 shows a manufacturing method in which the electron emitting materials filled in a container for impregnation are in the certain range. In this embodiment, as a container for impregnation, the container whose upper side is open, for example, a heat resistant metallic container made of Mo and W was used. The container has the size of 1.5 cm length ×1.5 cm width ×1 cm depth. The electron emitting materials are filled in the container for impregnation in an amount that changes in the range of 200 to 20000 times as much as an optimum amount of impregnation per pellet. 100 pellets were placed thereon and impregnated. The pellet has the average porosity of 20±1 vol. %, a diameter of 1.2 mm and the height of 0.42 mm. The 100 pellets were classified for weight at the precision of ±5 $\mu$g. After impregnation, extra electron emitting materials were removed and the weight was measured. Thus the increased weight, namely, the impregnated weight was calculated per pellet.

Figure 12:
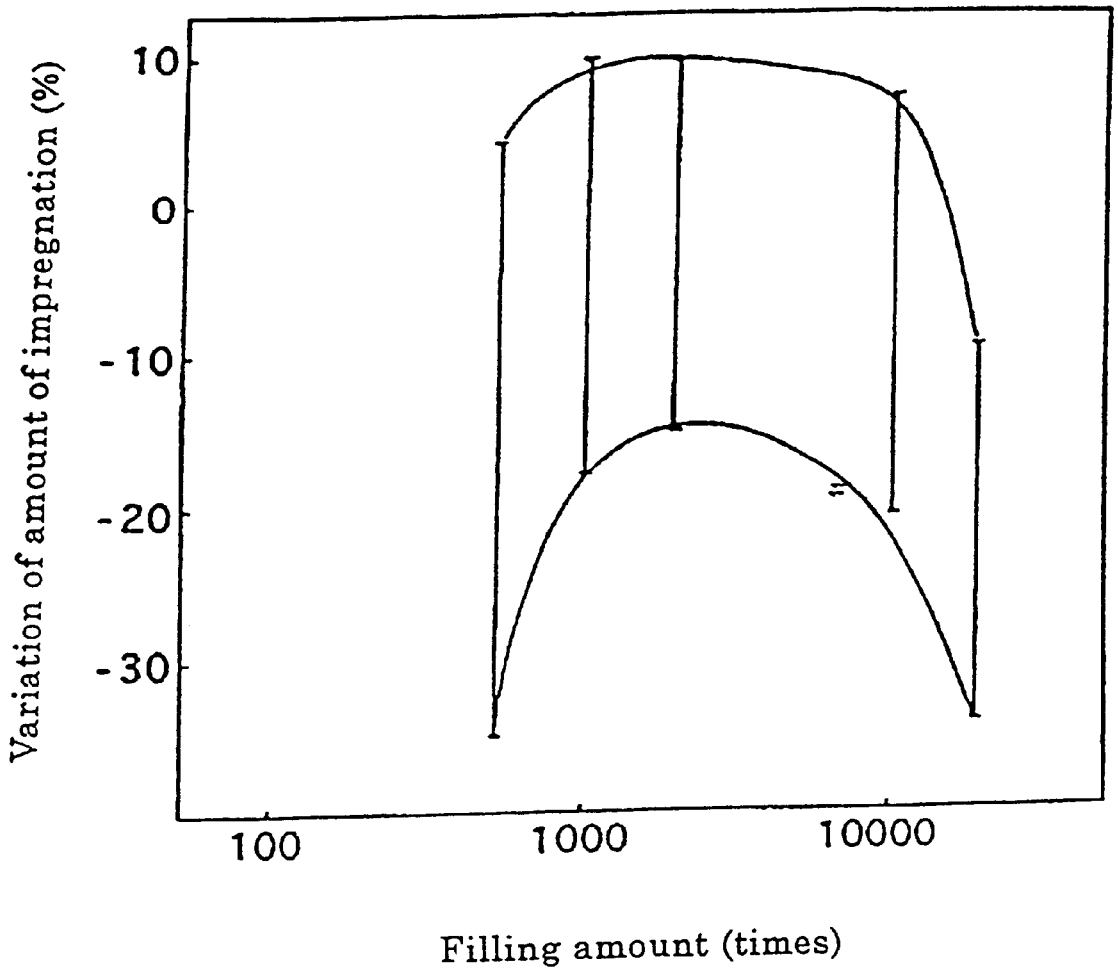
FIG. 12 is a graph showing the relationship between the amount of electron emitting material filled in a container for impregnation and the variation of the amount of impregnation to the pellet.

FIG. 12 is a graph showing the relationship between the amount of electron emitting materials filled in a container for impregnation and the variation of the amount of impregnation to the pellet. The horizontal axis of FIG. 12 shows the filling amount, which is expressed by the number of the pellets. Namely, the filling amount is expressed by how many times grater than the optimum amount of electron emitting material in the container that necessary for one pellet (hereafter, "filling amount" will be used for an abbreviation).

According to FIG. 12, if the filling amount is less than 1000 times, pellets that are not sufficiently impregnated are generated. This is because some substrates are not wetted on the whole surface of the porous substrate when the electron emitting materials are melted. When the filling amount is in the range of 1000 to 10000 times, the amount of an impregnation per pellet is nearly saturated, showing the optimal amount of impregnation.

When the filling amount exceeded 10000 times, the average amount of impregnation was decreased. This is because a great amount of gas is generated when the electron emitting materials are melted and prevents the electron emitting materials from entering the pore of the substrate. Furthermore, in a case where the bottom area of the container is increased, when the pellets are proportionally increased in accordance with the rate, the almost similar results can be obtained. From the above mentioned results, it is preferable that the filling amount is in the range of 1000 to 10000 times.

Moreover, as mentioned above, the filling amount is expressed by the weight per pellet. In this embodiment, since 100 pellets are placed in the container for impregnation, when the above mentioned filling amount is expressed by the value corresponding to the whole pellets located in a container for impregnation, the preferable range of weight of electron emitting material is in the range of 10 to 100 times.

Embodiment 10

Figure 13:
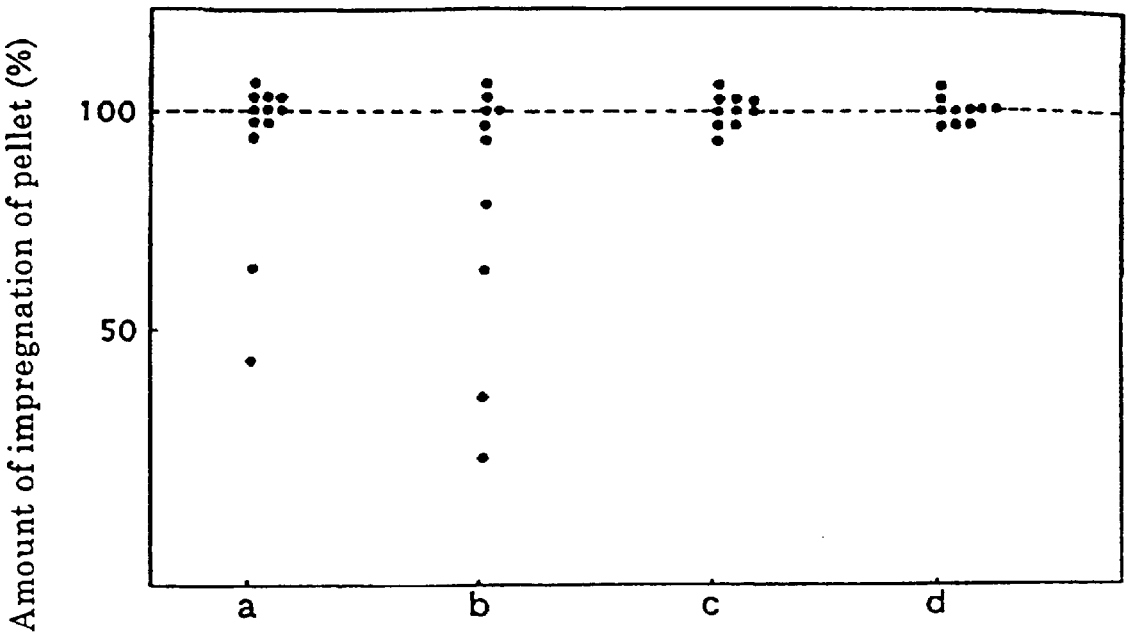
FIG. 13(A) is a graph showing the relationship between the location of the pellets at the time of impregnation and the amount of impregnation to the pellet of an impregnated cathode of one embodiment of the present invention.
FIG. 13(B) shows each location of the pellets in the container for impregnation.
Figure 13:
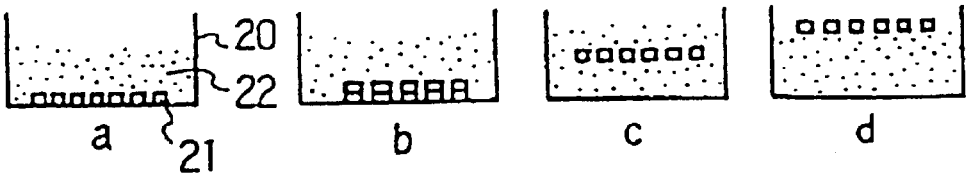

Embodiment 10 refers to a method for locating pellets on the containers for impregnation. In the method, the pellets are located in such a manner that the entire surface of the pellet contacts with the electron emitting materials at the times of impregnation. In this embodiment, the following experiments were carried out. The filling amount of the electron emitting materials was set to 3000 times, which is the preferable range shown in Embodiment 9. The impregnation was conducted in the following 4 kinds of pellet locations; a to d. FIG. 13(B) shows the location relationship of a container for impregnation 20, pellets 21 and electron emitting material 22, respectively in a case of a to d.

In a, 100 pellets were set in the same level in one stage on the bottom of the container for impregnation, and electron emitting material is filled on the pellets. In this location, the cylindrical bottom face of the pellets contact with the container for impregnation.

In b, 50 pellets per stage were set in two stages on the bottom of the container for impregnation, and electron emitting material is filled on the pellets. In this location, the cylindrical upper face of the pellet of the first stage contacts with the cylindrical bottom face of the pellet of the second stage. The cylindrical bottom face of the pellet of the first stage contacts with the bottom area of the container.

In c, electron emitting material is filled in the container for impregnation in a half amount by making the depth constant, then 100 pellets are set in the same level in one stage on the electron emitting material, and then the rest of the electron emitting material is uniformly filled by making the depth constant. In this location, the entire surface of the pellet contacts with the electron emitting materials.

In d, whole amount of electron emitting materials is placed in the container for impregnation by making the depth constant and 100 pellets are set in the same level in one stage. In this location, the cylindrical upper face of the pellet contacts with space.

FIG. 13(A) shows the relationship between the above mentioned locations and the amount of impregnation to the pellet. The horizontal axes a to d correspond to the above mentioned locations a to d.

In the location of the pellet in a and b, a few deficiencies in the impregnation occurred. In c and d, the amount of impregnation was excellent. This shows that unless the entire surface of the pellet is covered with electron emission materials, the amount of impregnation is insufficient. Moreover, in a case of d, in the state shown in FIG. 13(B), the entire surface of the pellet is not covered with electron emitting materials. However, as the electron emitting materials are melted, the pellets sink down in the electron emitting materials due to their weight, the whole surface is naturally covered with electron emitting material. In other words, it is an important condition for stable impregnation that the entire surface of the pellet is covered with electron emitting materials when the electron emitting materials are melted.

Embodiment 11

Embodiment 11 refers to a method for removing extra electron emitting materials attached to the pellet at the time of the impregnation. Extra emitting materials are physically removed by means of balls for grinding.

In this embodiment, the pellets impregnated under the optimum condition by the method of Embodiment 10 were used. These pellets were placed in the glass container having a volume of 100 $cm^3$ along with, for example, 10 alumina balls having a diameter of $\phi$=5 mm, and were subjected to shaking for 5 minutes to 1 hour. Then, the pellets were subjected to ultrasonic cleaning in ion exchanged water for 5 minutes, and dried in vacuum. The relationship between the shaking time and the fracture rate of the pellets at this time is shown in the following Table 3.

TABLE 3

| | Com. Ex. 1 | Com. Ex. 2 | Ex. 1 | Ex. 2 | Ex. 3 | Com. Ex. 3 | Com. Ex. 4 |
|---|---|---|---|---|---|---|---|
| Shaking time (minute) | 0 | 0 | 5 | 15 | 30 | 60 | 120 |
| Ultrasonic cleaning time (minute) | 5 | 60 | 5 | 5 | 5 | 5 | 5 |
| Fracture rate (%) | 0 | 0 | 0 | 0.2 | 0.3 | 1 | 3 |

Com. Ex.: Comparative Example
Ex: Example

Table 3 shows that in the pellet that was subjected to a shaking for 60 minutes or more (Comparative Example 3 and 4), the fracture rate of the pellets is rapidly increased.

Figure 14:
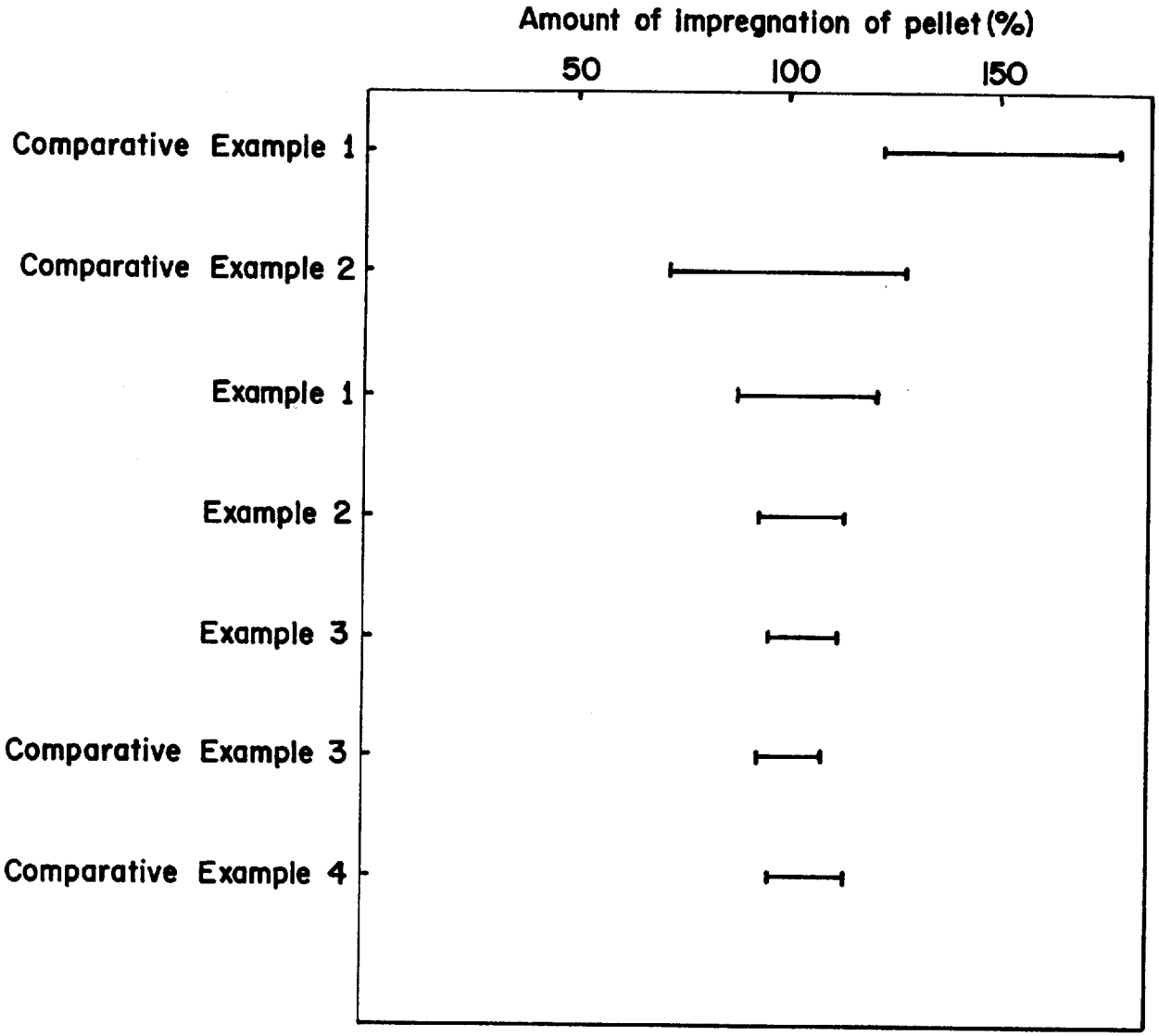
FIG. 14 is a graph showing the relationship between the shaking time and the amount of impregnation to the pellet of an impregnated cathode of one embodiment of the present invention and a comparative Example.

Furthermore, the amounts of impregnation to the pellets in Comparative Examples 1 to 4 and Examples 1 to 3 in Table 3 are shown in FIG. 14. FIG. 14 shows that the variation of the amount of impregnation to the pellet is minimum in Example 2 (the shaking time is 15 minutes). Since this variation reflects the attaching level of extra electron emitting materials, the pellet is excellent as this variation is smaller. The variation is small when the shaking time is 60 minutes or more (Comparative Examples 3 and 4), however, the fracture rate of the pellets is increased as mentioned above.

According to the results of the Comparative Examples 1 and 2 (no shaking was conducted), the variation per pellet is little decreased even if the cleaning time is increased when only the ultrasonic cleaning is conducted. This shows that effective electron emitting materials in pores, as well as extra electron emitting material, are removed over time. In addition, it is found that this method requires an absolutely long time of treatment. Consequently, it is not suitable for mass production.

Moreover, the conditions of the shaking or rolling, etc. freely can be changed by selecting the number of balls, size, volume of container, amount of the pellet to be treated, times, number of vibration frequency and amplitude of shaking, and rolling speed.

As mentioned above, in each embodiment, tungsten (W) was used as one example of the material constituting the pellet. However, the material is not limited to this alone, it may be the high melting point metals, for example, osmium (Os), ruthenium (Ru), iridium (Ir), rhenium (Re), tantalum (Ta), molybdenum (Mo), etc., an alloy comprising these metals, or materials based on these metals and comprising a small amount of additives.

Furthermore, in the above mentioned embodiments, the mixture comprising barium carbonate ($BaCO_3$), calcium carbonate ($CaCO_3$), aluminum oxide ($Al_2O_3$) in a mole ration of 4: 1: 1 was used as one example of electron emitting materials. The electron emitting material is not limited to this alone. The mixture in which the above mole ratio is changed may be used, and these mixtures in which a few amount of additives are dispersed may be used. Furthermore, instead of barium carbonate, barium oxide (BaO) may be used; and instead of calcium carbonate, calcium oxide (CaO) may be used.

Finally, it is understood that the invention may be embodied in other specific forms without departing from the spirit or essential characteristics thereof. The embodiments disclosed in this application are to be considered in all respects as illustrative and not restrictive, so that the scope of the invention being indicated by the appended claims rather than by the foregoing description, and all changes which come within the meaning and range of equivalency of the claims are intended to be embraced therein.

What is claimed is:

1. A method for manufacturing an impregnated cathode having a cathode pellet in which the pore portion of a sintered body of porous metal is impregnated with electron emitting material, comprising the steps of press molding metal raw material powder to form a porous substrate, said press molding being conducted after filling said metal raw material powder in a struck-level cartridge and then filling said raw material metal powder in a die by level striking measurement; wherein a face where said cartridge contacts a die surface has an annular shape and said cartridge has an inclined face in which an end portion of the outside of said cartridge contacts with said die surface.

2. The method for manufacturing an impregnated cathode according to claim 1, wherein an inner diameter of said annular shape is in the range of 10 to 20 times as large as the diameter of the pellet; an external diameter of said annular shape is in the range of 1.05 to 1.3 times as large as said inner diameter; and the angle that said inclined face makes with said die face is in the range of 40 to 80°.

3. The method for manufacturing an impregnated cathode according to claim 1, wherein an amount of metal raw material powder that is filled in said cartridge is equal to an amount of 200 to 800 cathode pellets.

4. The method for manufacturing an impregnated cathode according to claim 1, wherein said metal raw material powder is heated at a temperature in the range of 50 to 100° C. at the time of level striking measurement and pressing.

5. The method for manufacturing an impregnated cathode according to claim 1, wherein a face in which a punch contacts with metal raw material powder is referred to an electron emitting face; the relative descending speed of the punch to a die is in the range of 0.5 to 5 cm/s, and the pressing time is in the range of 1 to 7 seconds when the punch contacts with metal raw material powder.

6. A method for manufacturing an impregnated cathode having a cathode pellet in which a pore portion of a sintered body of porous metal is impregnated with electron emitting material, comprising the steps of: press molding metal raw material powder to form a porous substrate; and sintering said porous substrate to form a sintered body of porous metal; wherein the average porosity of said porous substrate after press molding is controlled by adjusting the pressure of press molding, and the average porosity of said sintered body of porous metal after sintering is controlled by adjusting the sintering temperature, wherein porosity distribution is controlled by adjusting the descending speed of the punch and the pressing time.

7.The method for manufacturing an impregnated cathode according to claim 6,wherein the average porosity (D volume %) of said porous substrate after press molding and the average porosity (d volume %) of said sintered body of porous metal after sintering have a relationship expressed by the following equation:

$$d+10 \leqq D \leqq d+20.$$

* * * * *